US009127686B2

(12) United States Patent
Lin

(10) Patent No.: US 9,127,686 B2
(45) Date of Patent: Sep. 8, 2015

(54) FAN ROTOR PROTECTION STRUCTURE

(75) Inventor: Shih-Chieh Lin, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 618 days.

(21) Appl. No.: 13/528,855

(22) Filed: Jun. 21, 2012

(65) Prior Publication Data

US 2013/0343903 A1 Dec. 26, 2013

(51) Int. Cl.

| | |
|---|---|
| ***F01D 5/14*** | (2006.01) |
| ***F04D 25/06*** | (2006.01) |
| ***F04D 29/08*** | (2006.01) |
| ***F04D 29/66*** | (2006.01) |

(52) U.S. Cl.

CPC ..... *F04D 25/0613* (2013.01); *F04D 29/083* (2013.01); *F04D 29/662* (2013.01)

(58) Field of Classification Search

CPC . F04D 25/0613; F04D 29/083; F04D 29/662; F04D 29/703; F04D 19/002

USPC ..... 416/234

See application file for complete search history.

(56) References Cited

U.S. PATENT DOCUMENTS

| | | | | |
|---|---|---|---|---|
| 7,189,053 | B2 * | 3/2007 | Winkler et al. | 415/108 |
| 2004/0075356 | A1 * | 4/2004 | Horng et al. | 310/154.08 |
| 2008/0036313 | A1 * | 2/2008 | Jiang et al. | 310/46 |

* cited by examiner

*Primary Examiner* — Dwayne J White
*Assistant Examiner* — Jason Fountain

(57) ABSTRACT

A fan rotor protection structure includes a fan wheel and an annular member. The fan wheel has a hub and a plurality of blades. The hub has a top portion and a side wall portion, which together define a receiving space in the hub. The annular member has one side aligned with and connected to an end surface of the side wall portion opposite to the top portion, and defines an opening communicable with the receiving space in the hub. With the annular member, foreign matters are stopped from entering into and accumulating in the fan rotor, enabling largely increased fan service life and more stable flow field around the fan.

8 Claims, 6 Drawing Sheets

FAN ROTOR PROTECTION STRUCTURE

FIELD OF THE INVENTION

The present invention relates to a fan rotor protection structure, and more particularly to a fan rotor protection structure that enables prolonged fan service life and more stable flow field around the fan.

BACKGROUND OF THE INVENTION

With the constantly widened applications in different fields thereof, cooling fans have been used with many electronic devices with special purposes, such as central processing units (CPU), servers, power supplies, communication chassis, and telecommunication base stations, to work in increasingly severe environments. Since the conventional cooling fans are not provided with any protective structure against the severe environments, they are actually not suitable for use in the environments constantly invaded by foreign matters.

It is known a rotor for the conventional cooling fan includes, from outside to inside, a plurality of blades, a housing, and a magnetic element. In consideration of good magnetic induction, a space left between the rotor and a motor of the cooling fan should not be purposefully increased. The space is considerably small and narrow compared to the size of the whole cooling fan. Generally, the magnetic element is made of a rubber material and the blades are made of a plastic material; therefore, both of them are relatively soft parts. Since the conventional cooling fan is not provided with any mechanism for removing the invaded tiny foreign matters, such as impurities and crystals, from the small and narrow space between the rotor and the motor of the fan, some abrasive impurities and external foreign matters tend to accumulate in the small space to constantly frictionally contact with the rotor, causing quick wear and damage of the rubber-made magnetic element and plastic-made blades. In worse conditions, the fan will become stuck or fail very soon and accordingly has largely shortened service life.

In addition, the housing and the magnetic element for the conventional fan rotor have relatively high surface roughness due to their materials, and therefore have higher resistance to the air flows produced by the fan when they flow through the housing and the magnetic element, which in turn causes unstable flow field around the fan.

In brief, the conventional fan rotor has the following disadvantages: (1) causing shortened fan service life; and (2) having higher resistance to air flows and therefore resulting in unstable flow field around the fan.

SUMMARY OF THE INVENTION

A primary object of the present invention is to provide a fan rotor protection structure that enables prolonged fan service life.

Another object of the present invention is to provide a fan rotor protection structure that enables more stable flow field around a fan.

To achieve the above and other objects, the fan rotor protection structure according to the present invention includes a fan wheel and an annular member. The fan wheel includes a hub and a plurality of blades. The hub has a top portion and a side wall portion axially extended rearward from a peripheral edge of the top portion. The blades are circumferentially spaced on the side wall portion of the hub. The top portion and the side wall portion together define a receiving space in the hub. The annular member has one side aligned with and connected to an end surface of the side wall portion opposite to the top portion, and defines an opening communicable with the receiving space in the hub.

In the fan rotor protection structure of the present invention, the annular member connected to the end surface of the side wall portion opposite to the top portion of the hub is able to stop impurities and external foreign matters from entering into and accumulating in the fan rotor, and accordingly reduces possible wear loss of the fan rotor due to frictional contact with foreign matters. In this manner, the fan rotor is protected against the risks of becoming stuck or fail easily, allowing the fan to have prolonged service life. Moreover, the annular member has smooth surfaces and can be made of a wear-resistant plastic material, an aluminum material, a stainless steel material or a wear and oxidation resistant material to have lower surface roughness than that of the fan wheel. Therefore the smooth annular member has lower resistance to the air flows produced by the fan and flowing into the fan, enabling a more stable flow field around the fan.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
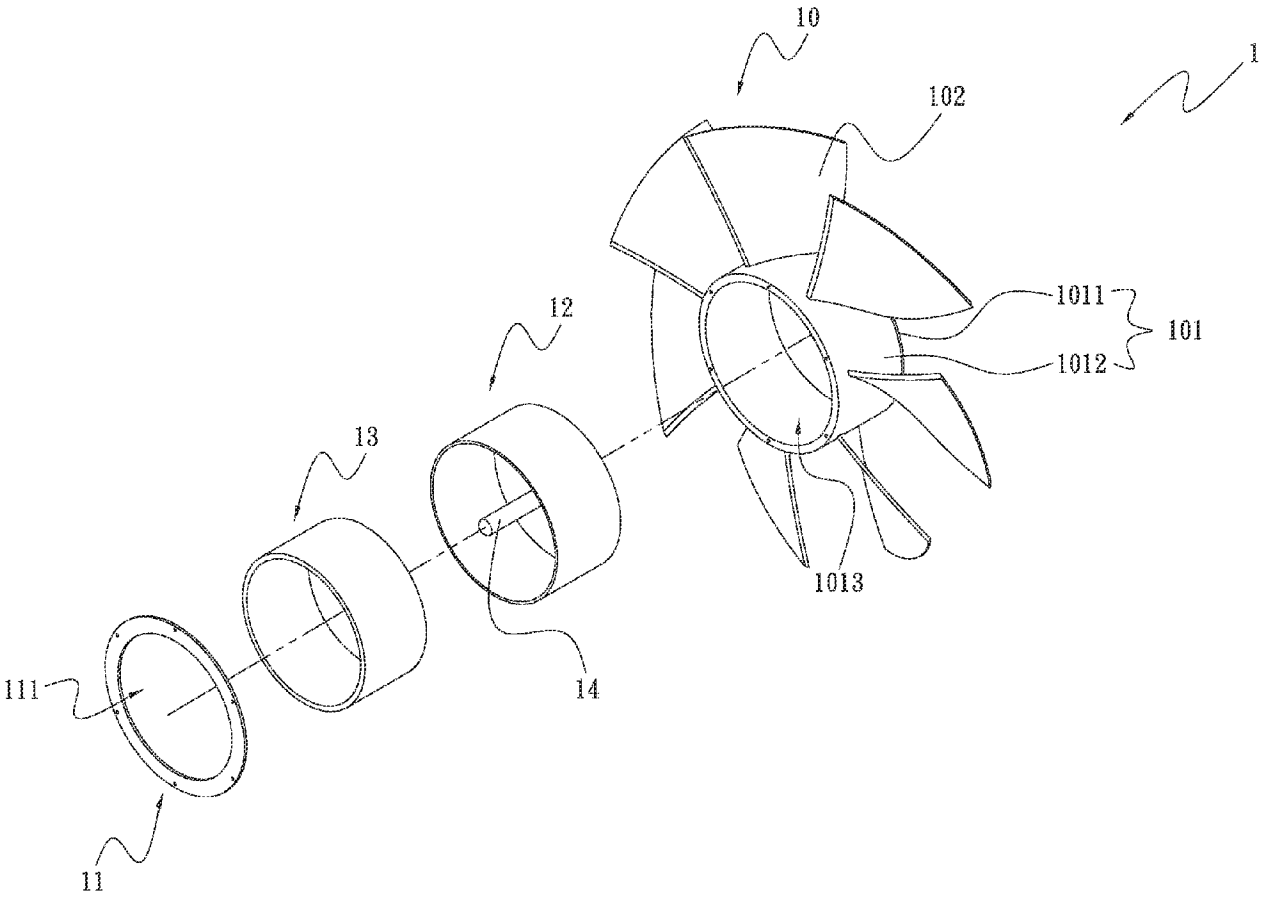
FIG. 1A is an exploded perspective view of a fan rotor protection structure according to a first embodiment of the present invention.

The present invention will now be described with some preferred embodiments thereof and with reference to the accompanying drawings. For the purpose of easy to understand, elements that are the same in the preferred embodiments are denoted by the same reference numerals.

Figure 1B:
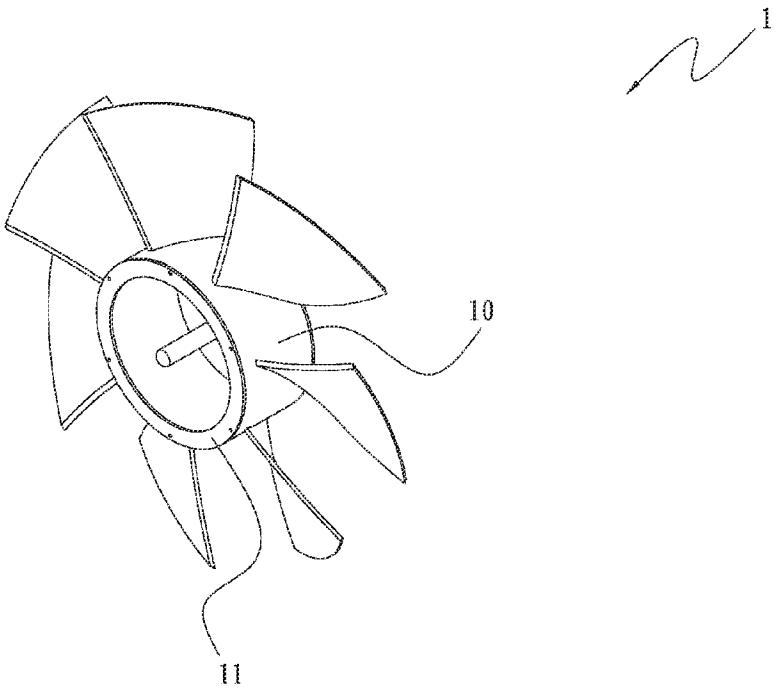
FIG. 1B is an assembled view of FIG. 1A.

Please refer to FIGS. 1A and 1B, which are exploded and assembled perspective views, respectively, of a fan rotor protection structure 1 according to a first embodiment of the present invention. As shown, the fan rotor protection structure 1 in the first embodiment includes a fan wheel 10 and an annular member 11. The fan wheel 10 includes a hub 101 and a plurality of blades 102. The hub 101 has a top portion 1011 and a side wall portion 1012 axially rearwardly extended from a peripheral edge of the top portion 1011. The blades 102 are circumferentially spaced on the side wall portion 1012. The top portion 1011 and the side wall portion 1012 together define a receiving space 1013 in the hub 101. The annular member 11 has one side aligned with and connected to an end surface of the side wall portion 1012 opposite to the top portion 1011, and defines an opening 111 communicable with the receiving space 1013 in the hub 101.

The fan rotor protection structure 1 further includes a housing 12 received in the receiving space 1013, and a magnetic element 13 fitted around an inner side of the housing 12. The side of the annular member 11 connected to the end surface of the side wall portion 1012 is also aligned with and connected to an end of the housing 12 and the magnetic element 13 facing away from the top portion 1011. A shaft 14 is provided in the housing 12 to axially locate at a central area thereof.

With the fan rotor protection structure 1 of the present invention, the annular member 11 has one side aligned with and attached to an end of the side wall portion 1012, the housing 12 and the magnetic element 13 opposite to the top portion 1011. The annular member 11 may be attached to the end of the side wall portion 1012, the housing 12 and the magnetic element 13 in different ways, such as adhesive bonding, hot melting, welding, insert molding, plastic insert molding, or snap fixing. With these arrangements, the annular member 11 functions to stop external impurities and foreign matters from entering into and accumulating in the fan rotor, and accordingly reduces possible wear loss of the fan rotor due to frictional contact with foreign matters. In this manner, the fan rotor is protected against the risks of becoming stuck or fail easily, and can therefore extend the fan service life.

The annular member 11 may be made of a wear-resistant plastic material, an aluminum material, a stainless steel material, or a wear and oxidation resistant material. Since the annular member 11 made of any of the above-mentioned material has surface smoothness higher than that of the end of the side wall portion 1012 of the hub 101 connected to the annular member 11, it has lower resistance to the air flows produced by the fan and flowing into the fan, enabling a more stable flow field around the fan without producing turbulent flows.

Figure 2A:
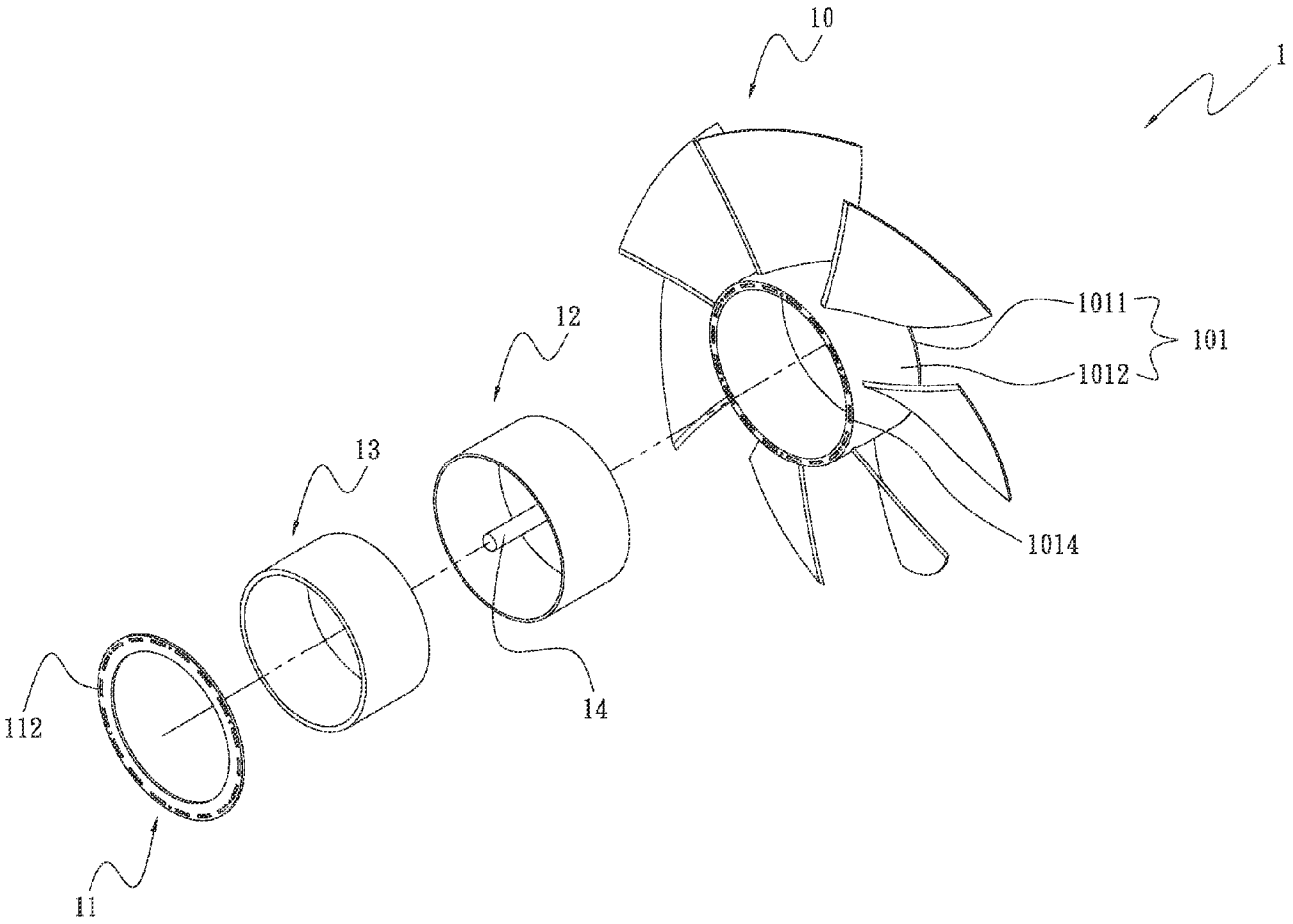
FIG. 2A is an exploded perspective view of a fan rotor protection structure according to a second embodiment of the present invention.
Figure 2B:
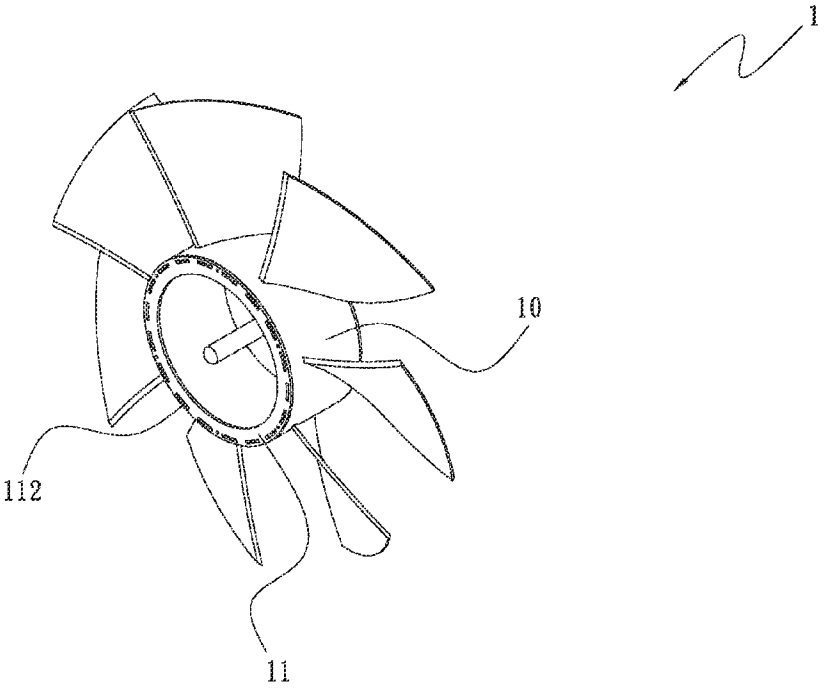
FIG. 2B is an assembled view of FIG. 2A.

FIGS. 2A and 2B are exploded and assembled perspective views, respectively, of a fan rotor protection structure 1 according to a second embodiment of the present invention. As show, the second embodiment is generally structurally similar to the first embodiment, except for a plurality of slots 1014 formed on and equally spaced along the end surface of the side wall portion 1012 of the hub 101 opposite to the top portion 1011 as well as a plurality of holes 112 formed on the annular member 11. The holes 112 on the annular member 12 are aligned and communicable with the slots 1014 on the end surface of the side wall portion 1012. In the event the fan rotor could not rotate in a balanced state, counterweights can be fitted in selected slots 1014 and holes 112 to achieve the purpose of adjusting the whole fan to a balanced state.

Figure 3A:
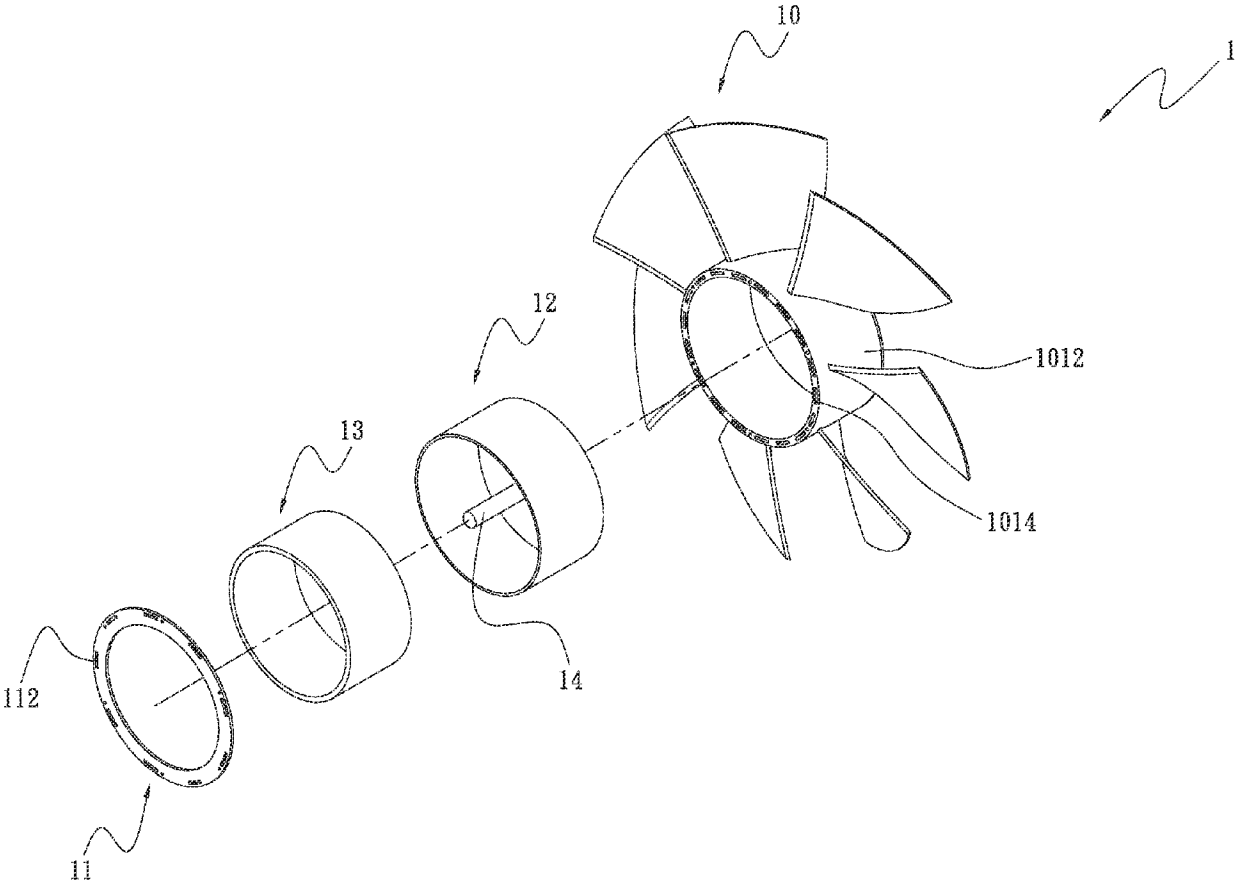
FIG. 3A is an exploded perspective view of a fan rotor protection structure according to a third embodiment of the present invention.
Figure 3B:
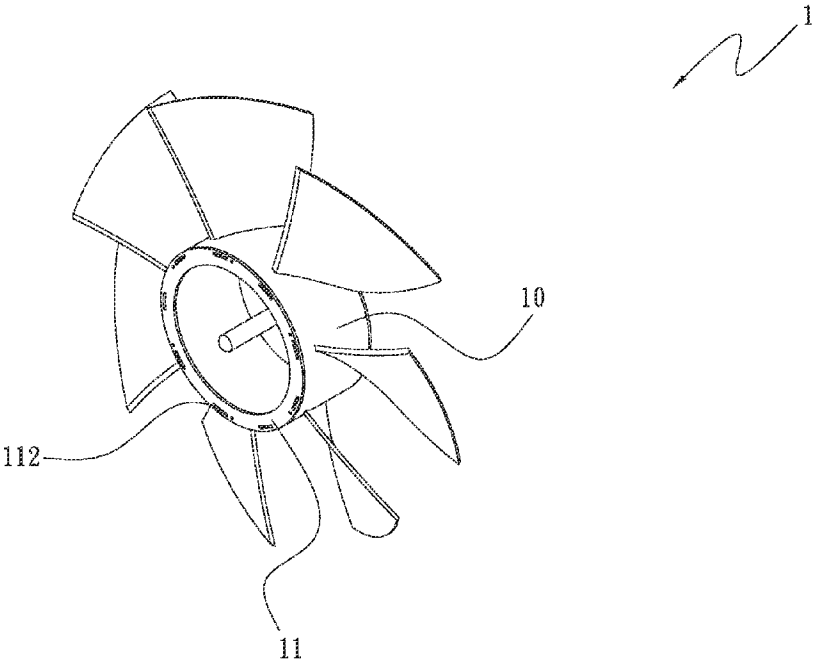
FIG. 3B is an assembled view of FIG. 3A.

FIGS. 3A and 3B are exploded and assembled perspective views, respectively, of a fan rotor protection structure 1 according to a third embodiment of the present invention. As show, the third embodiment is generally structurally similar to the second embodiment, except that the holes 112 formed on the annular member 11 are offset from the slots 1014 formed on the end surface of the side wall portion 1012 opposite to the top portion 1011. With the holes 112 and the slots 1014 formed and arranged according to the third embodiment, it is also possible to adjust an unbalanced fan to a balanced state by fitting counterweights in selected slots 1014 and holes 112.

In brief, the fan rotor protection structure according to the present invention provides the following advantages: (1) extending the fan's service life; and (2) enabling a more stable flow field around the fan.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan rotor protection structure, comprising:

a fan wheel including a hub and a plurality of blades; the hub having a top portion and a side wall portion axially rearwardly extended from a peripheral edge of the top portion, the blades being circumferentially spaced on the side wall portion, and the top portion and the side wall portion together defining a receiving space in the hub; and an annular member having one side aligned with and connected to an end surface of the side wall portion opposite to the top portion, and defining an opening communicable with the receiving space in the hub;

the annular member further being provided with a plurality of holes.

2. The fan rotor protection structure as claimed in claim 1, further comprising a housing received in the receiving space of the hub, and a magnetic element circumferentially arranged inside the housing; and the side of the annular member connected to the side wall portion of the hub being aligned with and connected to an end of the housing and the magnetic element facing away from the hub.

3. The fan rotor protection structure as claimed in claim 1, wherein the side wall portion of the hub is provided on the end surface opposite to the top portion with a plurality of circumferentially equally spaced slots.

4. The fan rotor protection structure as claimed in claim 3, wherein the plurality of holes are aligned and communicable with the slots on the end surface of the side wall portion.

5. The fan rotor protection structure as claimed in claim 3, wherein the plurality of holes are offset from the slots on the end surface of the side wall portion.

6. The fan rotor protection structure as claimed in claim 1, wherein the annular member is made of a material selected from the group consisting of a wear-resistant plastic material, an aluminum material, a stainless steel material, and a wear and oxidation resistant material.

7. The fan rotor protection structure as claimed in claim 1, wherein the annular member is connected at one side to the end surface of the side wall portion opposite to the top portion in a manner selected from the group consisting of adhesive bonding, hot melting, welding, plastic insert molding, and snap fixing.

8. The fan rotor protection structure as claimed in claim 2, further comprising a shaft axially located in the housing at a central area thereof.

* * * * *